US005983519A

United States Patent [19]

Ferrari

[11] Patent Number: 5,983,519

[45] Date of Patent: Nov. 16, 1999

[54] PRODUCT TRAY FOR DRYING A PRODUCT

[75] Inventor: Franco Ferrari, Zumikon, Switzerland

[73] Assignee: Bucher-Guyer AG, Switzerland

[21] Appl. No.: 09/011,265

[22] PCT Filed: May 21, 1997

[86] PCT No.: PCT/CH97/00196

§ 371 Date: Jan. 30, 1998

§ 102(e) Date: Jan. 30, 1998

[87] PCT Pub. No.: WO97/46841

PCT Pub. Date: Dec. 11, 1997

[30] Foreign Application Priority Data

May 31, 1996 [CH] Switzerland ..... 1372/96

[51] Int. Cl.[6] ..... F26B 11/18

[52] U.S. Cl. ..... 34/192; 34/238

[58] Field of Search ..... 34/246, 247, 380, 34/381, 418, 420, 442, 60, 61, 85, 89.1, 94, 95, 103, 107, 192, 194, 197, 237, 238; 206/725, 728; 211/26, 70.6, 60.1, 126.1, 150; 248/210, 211; 219/213, 216, 432, 435, 528, 548, 552, 730; 435/291.2; D32/53.1

[56] References Cited

U.S. PATENT DOCUMENTS

| | | | |
|---|---|---|---|
| 3,807,057 | 4/1974 | Noel | 34/237 |
| 4,190,757 | 2/1980 | Turpin et al. | 219/730 |
| 4,455,763 | 6/1984 | Elevitch | 34/233 |
| 4,677,764 | 7/1987 | Cerny | 34/195 |
| 4,751,368 | 6/1988 | Diafotes | 219/432 |
| 4,943,534 | 7/1990 | Andreasen | 435/302 |

FOREIGN PATENT DOCUMENTS

| | | |
|---|---|---|
| 812659 | 9/1951 | Germany . |
| 899925 | 12/1953 | Germany . |
| 19516291 | 7/1996 | Germany . |
| WO9746841 | 12/1997 | WIPO . |

OTHER PUBLICATIONS

International Search Report dated Aug. 6, 1997.

*Primary Examiner*—Henry Bennett
*Assistant Examiner*—Steve Gravini
*Attorney, Agent, or Firm*—Burns, Doane, Swecker & Mathis

[57] ABSTRACT

A product tray (3) has a bottom (7), which is improved in respect to heat transfer between a heating plate (8) and the product (9). The bottom (7) is made of a flexible, thin, heat-resistant material. It therefore can make a good form fit to the heating plate (8) under good heat contact, in particular when weighted down by the product (9).

8 Claims, 6 Drawing Sheets

Figure 1:
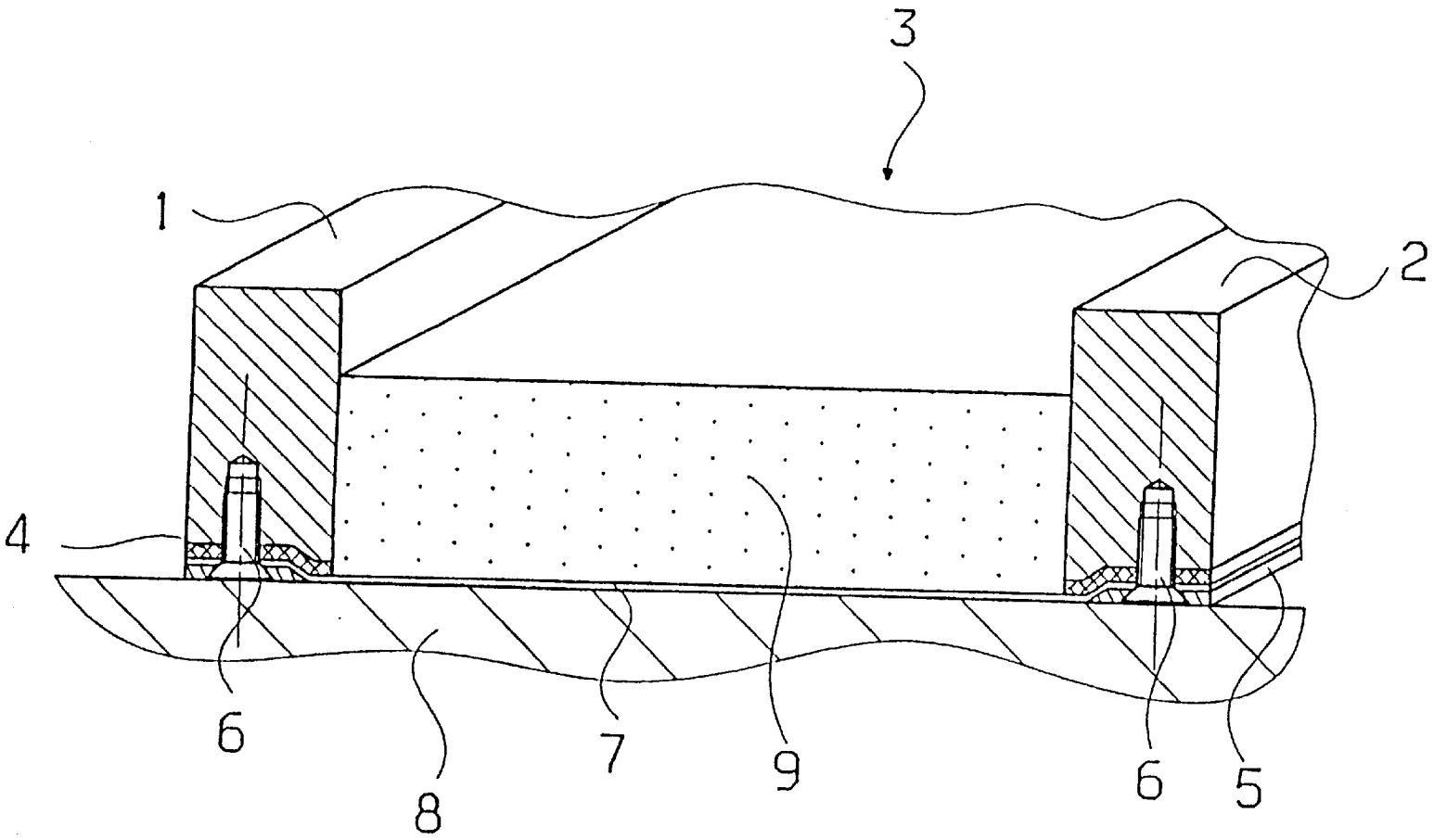

Fig. 2
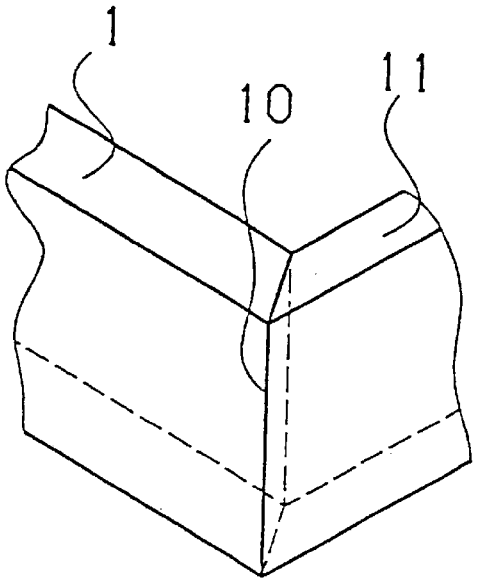
Fig. 3
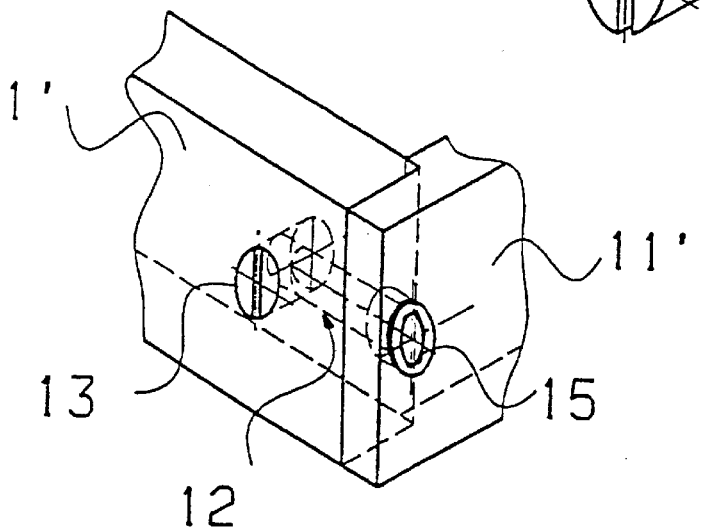
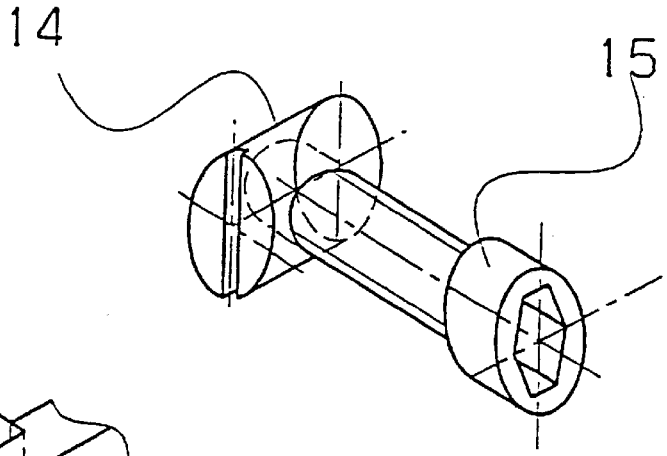
Fig. 3a

PRODUCT TRAY FOR DRYING A PRODUCT

The invention relates to a product tray for drying a product by means of contact heating by heating plates extending over the tray bottom.

Known product trays of the type mentioned consist of deep-drawn plastic materials, such as polypropylenes or polyethylene. Because of a change in their shape under the effect of heat, these trays are not always in form-fitting contact with the heating plate. Furthermore, their relatively thick walls hamper the heat transfer from the heating element to the product. However, a satisfactory and even heat transfer at the bottom of the product trays plays an essential role in the quality of drying by means of contact heating in a vacuum drying cabinet. The quality of drying is determined by the degree of drying, foaming and length of drying.

To assure even temperature distribution and an even degree of drying in the overall product, the following conditions must be met:

a. Stable shape of the product trays (in particular the bottom) during drying, b. Good contact between the heating plate and the tray bottom over the entire surface, even small hollow spots constituting insulators hamper the heat transport, c. An overall even wall thickness of the tray bottoms, and d. Even heat distribution in the heating plates.

To meet these conditions better, product trays made of metal, such as stainless steel or aluminum, are known. However, damages to and unevenness in the bottom results during knocking the dry product cake out, which leads to uneven drying.

It is the object of the invention to avoid the mentioned disadvantages of known product trays.

In accordance with the invention, this object is attained in connection with a product tray of the type mentioned at the outset by a frame which constitutes or supports the lateral walls of the product tray, and by a bottom consisting of a thin, flexible, heat-resistant material with good heat conduction.

Features of preferred embodiments of the invention are recited in the dependent claims.

The following properties are among the advantages gained by means of the invention:

1. The flexible material of the bottom of the product tray allows optimal contact between the bottom and the heating plate. The material adapts to small unevennesses of the heating plate, so that no insulating air cushions are being created between the heating surface and the product to be dried.

2. The small thickness of the bottom allows a good heat passage, so that the heat is conducted into the product very quickly. Because of the resulting reduced length of drying time, the quality of drying is improved in comparison with known tray types. Comparative measurements have shown that reductions of the length of drying time of 40 to 500% can be achieved.

3. If the product is placed warm into the product trays, it is known that during the evacuation of the installation extensive cooling of the product mass takes place because of the evaporation of the volatile components. This leads to an increase in the viscosity of the product with the result of the undesired, too violent foaming of the product. Under certain conditions such foaming can lead to the soiling of radiating heating plates arranged above the product. With the product trays in accordance with the invention, the viscosity of the product remains low because of the rapid heat transfer, and foaming because of entrapped air is less marked.

4. Because of the good heat penetration, there is also faster cooling of the product at the end of the drying process, along with a further gain in time.

5. In most cases, tipping of the trays and slight knocking against the flexible bottoms for emptying the dried product cake out of the product trays is sufficient for a product removal free of losses to a large extent.

Figure 4:
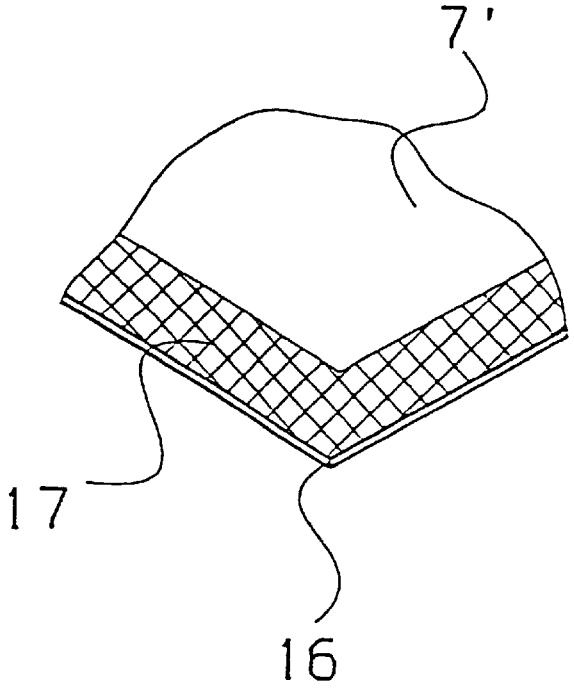
Figure 5:
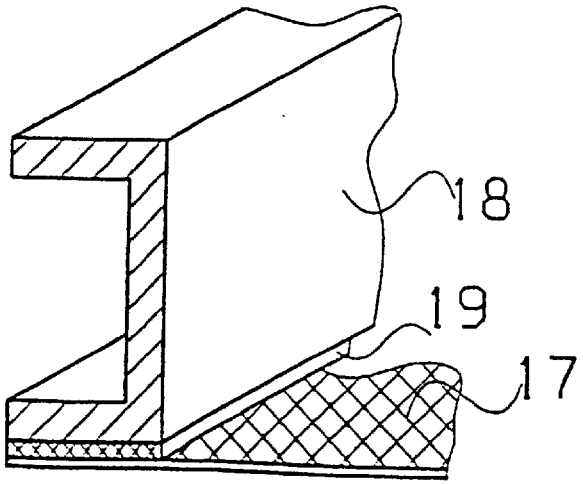
Figure 6:
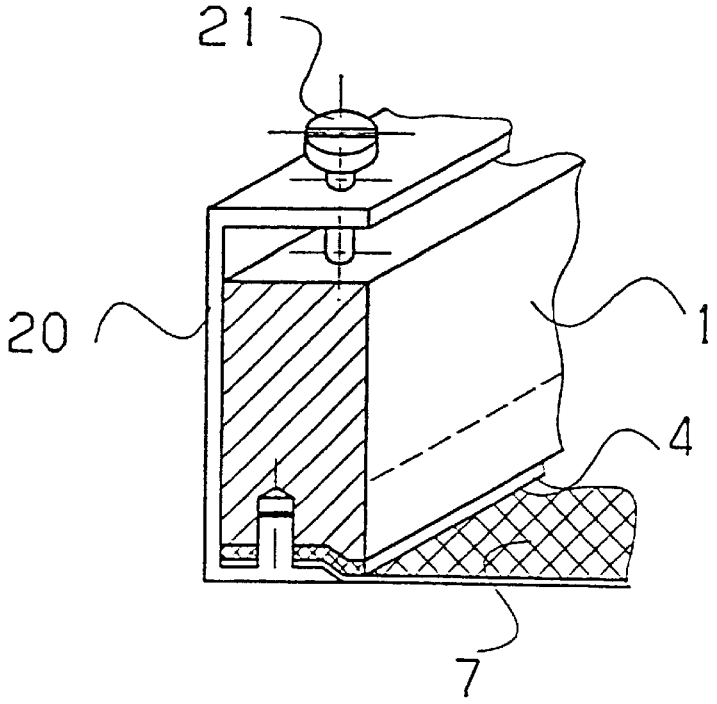
Figure 7:
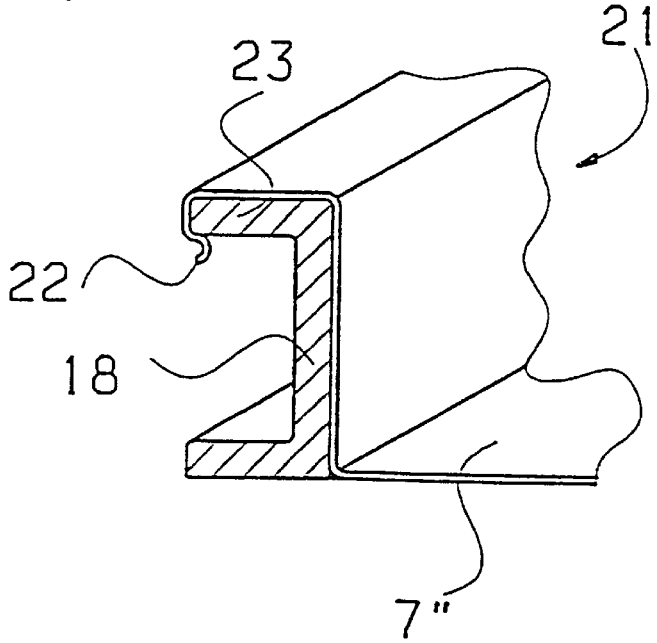
Figure 8:
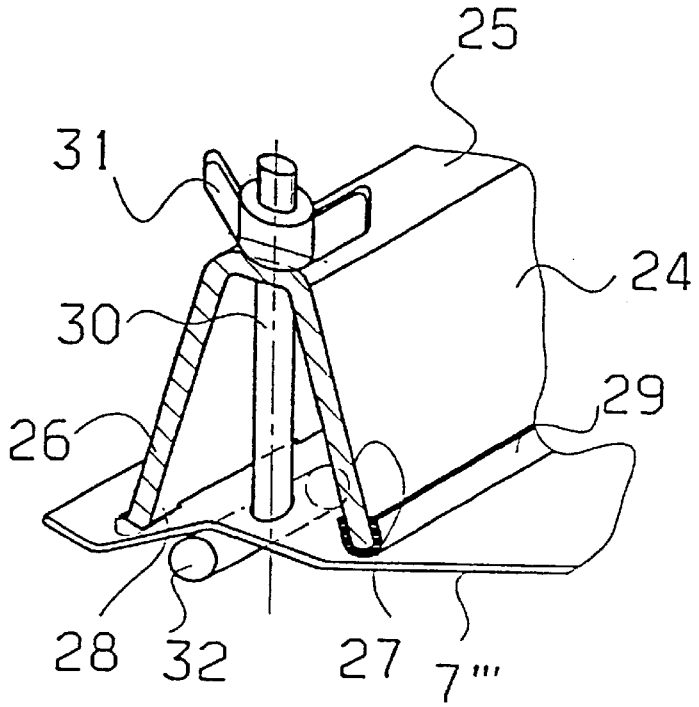
Figure 9:
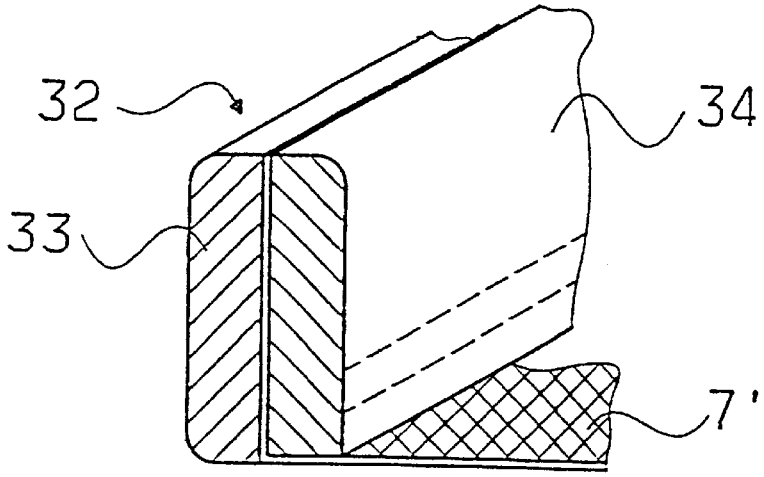
Figure 10:
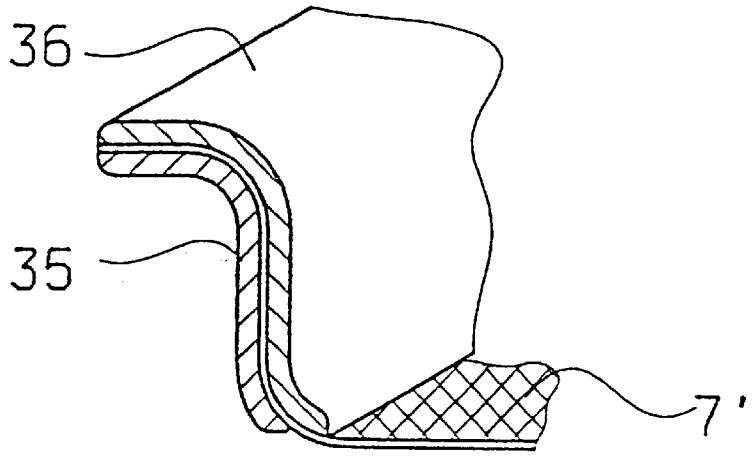
Figure 11:
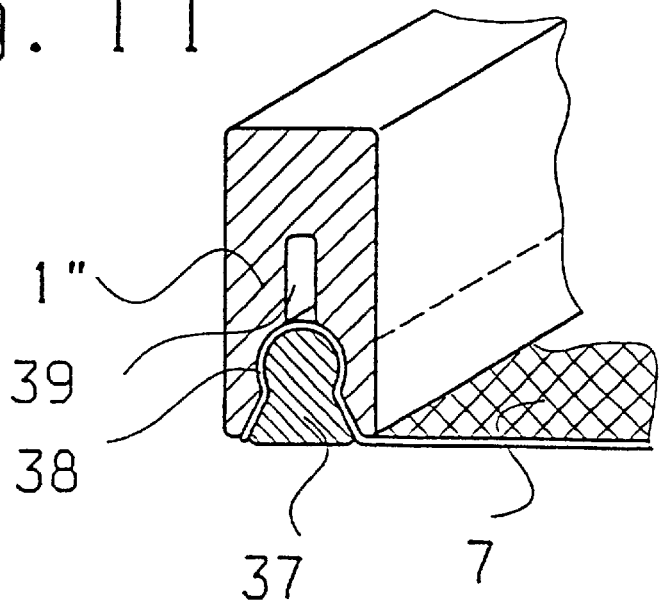

The invention will be described in detail in the following description and in the drawings, which represent exemplary embodiments. Shown are in:

FIG. 1, a vertical sectional view parallel with the lateral wall of a product tray in accordance with the invention on a heating plate, FIG. 2, a detailed view of a vertical edge of a tray frame of a product tray in accordance with the invention, FIG. 3, a detailed view of a vertical edge of a tray frame of a further product tray assembled by means of a tension rod, FIG. 3*a*, a tension rod in accordance with FIG. 3 in detail, FIG. 4, a detailed view of a corner of a tray bottom for a product tray in accordance with FIGS. 1, 2 or 3, FIG. 5, a vertical sectional view parallel with a lateral wall of a product tray in accordance with the invention with a tray bottom fastened by an adhesive, FIG. 6, a vertical sectional view parallel with a lateral wall of a product tray in accordance with the invention with a tray bottom fastened by a clamping frame, FIG. 7, a vertical sectional view parallel with a lateral wall of a product tray in accordance with the invention with a tray bottom as a portion of a deep-drawn pan, whose edges are fastened to a tray frame by snapping them on it, FIG. 8, a vertical sectional view parallel with a lateral wall of a product tray in accordance with the invention with a tray bottom fastened by means of clamping bolts on a tray frame, FIG. 9, a vertical sectional view parallel with a lateral wall of a product tray in accordance with the invention with a tray bottom fastened by means of a tray frame in sandwich construction, FIG. 10, a vertical sectional view parallel with a lateral wall of a product tray in accordance with the invention with a tray bottom fastened between two profiled steel pieces constituting the tray frame, and FIG. 11, a vertical sectional view parallel with a lateral wall of a product tray in accordance with the invention with a tray bottom fastened on a tray frame by means of snap-on strips.

The vertical sectional view in accordance with FIG. 1 shows two oppositely located lateral walls 1, 2 of a rectangular product tray 3 in accordance with the invention. A flexible, thin, heat-resistant woven material is fastened as the tray bottom 7 to the lower edges of all four lateral walls of the product tray 3 over an edge reinforcement or seal 4 by means of clamping strips 5 and screws 6. The product tray 3 rests with the tray bottom 7 and the clamping strips 5 on a heating plate 8 for drying a product 9 located in the product tray. The flexible tray bottom 7 rests all over form-fittingly on the entire heating plate 8 because of the weight of the product 9, because of its reduced thickness it offers a good heat transfer from the heating plate 8 to the product 9 which is to be dried.

FIG. 2 shows a vertical edge 10 of a product tray in accordance with FIG. 1. Two lateral walls 1 and 11 are put together at their panel edges in a manner known per se by gluing or welding. Stainless steel is a preferred material for a welding treatment of the plates or profile sections of the lateral walls. Such tray frames suitable for product trays are offered by numerous sheet-metal-processing companies, for example the Wegmann company, Spreitenbach, Switzerland. Tray frames can also be welded together from profiled aluminum sections, the Aluminium Menziken AG, Menziken, Switzerland, should be mentioned among the suppliers of such frames.

However, tray frames in accordance with FIG. 2 can also be made of plastic by vacuum deep-drawing, for example of polypropylene, PTFE or other plastic materials. Many plastic processors are known as producers, for example the Sigmund company, Mosbach, Germany, or the Colasit company, Spiez, Switzerland. Alternatively, extruded profile sections made of polypropylene or polyethylene are also suitable for welding together, which can be provided by the Keller company, Bischoffszell, Switzerland, and HAKA AG, Gossau SG, Switzerland. However, product trays made of polypropylene are not suitable for very sticky products 9.

If sufficiently large numbers are required, the manufacture of one-piece tray frames, or of one-piece elements thereof, made of polypropylene by means of injection molding processes is efficient, such as provided, for example, by the Utz company, Bremgarten, Switzerland. In other cases tray frames can be put together from standard elements. FIG. 3 represents two lateral walls 1' and 11' of a product tray (FIG. 1), which are put together by means of a tension rod 12 at a vertical edge. Such a tension rod of a type known per se is shown in detail in FIG. 3*a*. A bolt 14 has been inserted in a hole 13 of the lateral wall 1', to which the lateral wall 11' is screwed with a threaded pin 15 through a bore alongside of the lateral wall 1'.

Different types of the embodiment and fastening of tray bottoms on tray frames are shown in FIGS. 4 to 10. FIG. 4 shows a corner 16 of a cloth as the tray bottom 7'. Various plastic materials are suitable as material for producing such cloths. Aramide fibers Kevlar (aromatic polyamide);and after "or Normex" insert or Nomex, coated with PTFE (polytetrafluoro- ethylene), are known as organic fibers, with a high modulus of elasticity, supplied by Du Pont de Nemours Int. SA, Geneva, Switzerland. PTFE is known under the trade name Teflon (fluorine synthetie material), supplied by Du Pont de Nemours Int. SA, Geneva, Switzerland, or Hostalen (polyethylene), supplied by Hoechst, Frankfurt/Main, Germany.

Woven materials of fiberglass, whose surface has been coated with a plastic material, for example PTFE or a silicon, are furthermore suitable as material for tray bottoms. Such woven materials can be provided, for example as Lubriglas tapes, by the Angst und Pfister company, Zurich, Switzerland, or as silicon- coated woven fiberglass foils by the SIPOTEC company, Chur, Switzerland. An edge zone 17 of the tray bottom 7' has been specially chemically treated (etched) in FIG. 4, so that it can be glued to a tray frame 18 by means of an adhesive layer 19, as shown in FIG. 5. Two-component adhesives on the basis of epoxy resins, for example Araldit (synthetic resin) of the CIBA Polymere company, Basel, Switzerland, are suitable for this.

It is possible to use, besides woven materials, also plastic foils for the tray bottoms, for example of pure PTFE (polytetrafluoroethylene), or of fiberglass-reinforced PTFE, such as are available from the Neotecha AG company, Hombrechtikon, Switzerland. Furthermore, foils made of polyethylene with thicknesses between 0.5 mm to 1 mm can also be usable for this, known, for example, under the trade name Hostalen or Hostalen-GUR from Hoechst AG, Frankfurt/Main, Germany.

Finally, woven polyesters, for example Trevira from Hoechst or Tersuisse from Viscosuisse, are also suitable for tray bottoms. Such woven materials, coated with polyurethane of a total thickness of approximately 0.6 mm, are provided by the HABASIT company, Reinach BL, Switzerland. They are mainly suitable for less adhesive products at temperatures below 80° C.

FIG. 6 shows the fastening of a bottom material 7 on a lateral wall 1 of a product tray by means of a clamping frame 20. The bottom material 7 is pressed along the clamping frame 20 against the side of the lateral wall 1 over an edge reinforcement or seal 4 by means of several clamping screws 21.

FIG. 7 shows a tray bottom 7", which is embodied as a part of a deep-drawn pan 21, but is sufficiently flexible. For fastening, the material of the pan 21, preferably stainless steel or plastic, permits the upper edge 22 of the pan 21 to snap over the edge 23 of the tray frame 18.

A further preferred option of fastening a thin flexible tray bottom 7'" on the lateral walls 24 of a product tray in accordance with the invention is represented in a vertical sectional view in FIG. 8. Here, the lateral walls 24 are embodied as V-shaped profile sections with an edge 25 located at the top. The ends 26, 27 of the legs of the V-shaped profile sections rest on the tray bottom 7'". In this case the outer end 26 is fixed in place in corresponding elongated holes in the tray bottom 7'" by means of protrusions 28, while the inner end 27 is supported via an edge protector 29 on the tray bottom 7'". As shown in FIG. 8, the tray bottom 7'" is fastened and tensed on the lateral walls 24 with bolts 30 and screws 31 along the lateral walls. In this case the bolts 30 hold the tray bottom 7'" by means of counterparts 32, and the screws 31 are supported on the edges 25 of the V-shaped profile sections. The lateral walls 24 are preferably made of metal.

FIG. 9 shows in a vertical sectional view a possibility of fastening a flexible tray bottom 7' on a tray frame 32 by means of a sandwich-like arrangement. The tray frame 32 comprises an outer element 33 and inner element 34 and, as already shown in FIG. 4, the tray bottom 7' has an edge zone 17, which has been specially treated chemically (by etching) or physically (by plasma surface activation), so that it can be fastened between the elements 33 and 34 by melting or gluing and compression.

A variant of the arrangement of FIG. 9 is represented in FIG. 10. Here, the edge zone of the tray bottom 7' is fastened between two steel frames 35, 36.

In the exemplary embodiment in accordance with FIG. 11, it is shown how a tray bottom 7 is fastened at the lower edge of a lateral wall 1" of a product tray by means of a snap-on strip 37. In this case, too, the tray bottom 7 has an edge zone, which can be simply fixed in place between the elements 1" and 37 by clamping. The lateral wall 1" has a groove 38 suitable for receiving the snap-on strip 37, which has a depression 39 on its bottom for improving the elastic properties of the lateral wall 1" when being snapped-in. This variant is primarily suitable for employing elastic tray bottoms made of elastomers (silicon-coated woven fiberglass).

I claims:

1. A product tray (3) for drying a product (9) by means of contact heating by heating plates (8) extending over the tray bottom (7), characterized by a frame constituting or supporting the lateral walls (1, 2, 11, 18, 24) of the product tray (3), and a bottom (7), consisting of a flexible, thin, material with good heat conduction and resistance to being damaged by heat encountered in the drying of the product.

2. The product tray in accordance with claim 1, characterized in that the bottom (7) is designed as a welded-in plastic foil.

3. The product tray in accordance with claim 1, characterized in that the bottom (7) comprises a woven material (7', 7''', 17) clamped on the edge of the frame (1, 2, 11, 18, 24).

4. The product tray in accordance with one of claim 1, characterized in that the bottom (7) has an anti-adhesive layer (7').

5. The product tray in accordance with claim 1, characterized in that the frame (1, 2, 11, 18) consists of a plastic material.

6. The product tray in accordance with claim 1, characterized in that the frame (1, 2, 11, 18, 24) consists of stainless steel or of aluminum.

7. The product tray in accordance with claim 1, characterized in that the bottom (7, 7'', 71''') of the product tray (3) can be exchanged on the frame (1, 2, 11, 24).

8. A product tray in accordance with claim 1, wherein said bottom is an aramid fiber web impregnated with polytetrafluoroethylene.

* * * * *